US012722919B2

(12) United States Patent
Shibayama

(10) Patent No.: US 12,722,919 B2
(45) Date of Patent: Sep. 1, 2026

(54) PAPER FEEDING APPARATUS AND IMAGE FORMING APPARATUS

(71) Applicant: SHARP KABUSHIKI KAISHA, Sakai City (JP)

(72) Inventor: Tsuyoshi Shibayama, Sakai City (JP)

(73) Assignee: SHARP KABUSHIKI KAISHA, Sakai City (JP)

( * ) Notice: Subject to any disclaimer, the term of this patent is extended or adjusted under 35 U.S.C. 154(b) by 0 days.

(21) Appl. No.: 19/050,264

(22) Filed: Feb. 11, 2025

(65) Prior Publication Data

US 2026/0233955 A1 Aug. 13, 2026

(51) Int. Cl.
*B65H 1/26* (2006.01)
*B65H 3/68* (2006.01)

(52) U.S. Cl.
CPC ..... *B65H 1/266* (2013.01); *B65H 3/68* (2013.01); *B65H 2402/441* (2013.01); *B65H 2601/324* (2013.01)

(58) Field of Classification Search
CPC . B65H 1/266; B65H 3/66; B65H 3/68; B65H 2402/441; B65H 2405/31; B65H 2405/32; B65H 2405/324; B65H 2601/324
See application file for complete search history.

(56) References Cited

U.S. PATENT DOCUMENTS

| | | | | |
|---|---|---|---|---|
| 11,370,624 | B2 * | 6/2022 | Uchida | B65H 3/66 |
| 11,572,240 | B2 * | 2/2023 | Koga | B65H 3/66 |
| 2017/0031295 | A1 * | 2/2017 | Matsumoto | B65H 29/22 |
| 2017/0060066 | A1 * | 3/2017 | Fujita | B65H 3/0638 |
| 2017/0088373 | A1 | 3/2017 | Tahara et al. | |

FOREIGN PATENT DOCUMENTS

| | | |
|---|---|---|
| JP | 2017-065865 A | 4/2017 |
| JP | 2021-062951 A | 4/2021 |

* cited by examiner

*Primary Examiner* — Prasad V Gokhale
(74) *Attorney, Agent, or Firm* — ScienBiziP, P.C.

(57) ABSTRACT

A paper feeding apparatus includes: a pickup roller that pulls out, on a one-by-one basis, sheets stacked on a paper feeding cassette; a paper feeding roller that sends, to a conveyance path, a sheet pulled out by the pickup roller; a separation roller that abuts on the paper feeding roller and prevents double feeding of the sheets; a roller arrangement space in which the pickup roller, the paper feeding roller, and the separation roller are arranged; a work space that communicates with the roller arrangement space and is for taking out the pickup roller, the paper feeding roller, or the separation roller; a guide portion that closes the work space so that the sheet can pass through the work space and guides the sheets stacked on the paper feeding cassette to the conveyance path; and a roller cover that is arranged in the guide portion and exposes the work space. The roller cover is arranged slidably in an insertion and removal direction of the paper feeding cassette.

4 Claims, 9 Drawing Sheets

PAPER FEEDING APPARATUS AND IMAGE FORMING APPARATUS

BACKGROUND OF THE DISCLOSURE

1. Field of the Disclosure

The present disclosure relates to a paper feeding apparatus and an image forming apparatus.

2. Description of the Related Art

A known paper feeding apparatus is provided with a paper feeding unit including a paper feeding roller, a separation roller, and a pickup roller in order to feed sheets stacked on a paper feeding cassette. In such a paper feeding apparatus, a work space is required in an axial direction of the rollers in order to replace the rollers constituting these paper feeding units at the time of maintenance.

As such an example, a known paper feeding apparatus has a configuration including a separation cover that guides movement of a sheet passing through the separation roller and is movable to a cover position for covering a mounting groove and a retraction position for exposing the mounting groove. In addition, a known paper feeding apparatus has a configuration in which a paper feeding holder slides and is attached and detached.

The known paper feeding apparatus is configured as described above to improve the replacement property of rollers at the time of maintenance. At the time of replacement of rollers of the paper feeding apparatus, it is necessary to remove a cover member near the roller in order to provide a work space in the axial direction of the roller. Some of the rollers of the paper feeding apparatus are provided in a lower portion of the paper feeding apparatus, making it difficult for a worker to visually recognize the rollers and making it necessary for the worker to perform manual work. Therefore, it is necessary to return the cover member to the original position after replacement of the rollers, but there has been a case where the cover member is left unattached or an attachment error of not accurately returning to the original position occurs, resulting in a problem such as pull-in failure.

The present disclosure has been made to solve the above-described problem, and an object of the present disclosure is to provide a paper feeding apparatus and an image forming apparatus that can reliably return a cover member to an original position at the time of maintenance and eliminating an unstable factor of pull-in failure.

SUMMARY

A paper feeding apparatus according to the present disclosure includes: a pickup roller that pulls out, on a one-by-one basis, sheets stacked on a paper feeding cassette; a paper feeding roller that sends, to a conveyance path, a sheet pulled out by the pickup roller; a separation roller that abuts on the paper feeding roller and prevents double feeding of the sheets; a roller arrangement space in which the pickup roller, the paper feeding roller, and the separation roller are arranged; a work space that communicates with the roller arrangement space and is for taking out the pickup roller, the paper feeding roller, or the separation roller; a guide portion that closes the work space so that the sheet can pass through the work space and guides the sheets stacked on the paper feeding cassette to the conveyance path; and an opening and closing member that is arranged in the guide portion and exposes the work space, in which the opening and closing member is arranged slidably in an insertion and removal direction of the paper feeding cassette.

Preferably, the opening and closing member is arranged from the paper feeding roller or the separation roller to an end portion of a sheet stacked on a paper feeding cassette on a pullout direction side of the paper feeding cassette with respect to the paper feeding roller or the separation roller.

More preferably, the opening and closing member includes an end portion on a side different from an end portion where the space is exposed, and the end portion of the opening and closing member on the side different from the end portion where the space is exposed is slid to an outside of a process unit cover that covers a process unit that forms an image.

The opening and closing member may include an abutment portion at an end portion different from an end portion where the work space is exposed, and when the paper feeding cassette abuts on the abutment portion, the opening and closing member may be slid in a direction of closing the work space.

In another aspect of the present disclosure, the image forming apparatus includes any one of the paper feeding apparatuses described above.

According to the present disclosure, since the guide portion includes the opening and closing member that exposes the work space for taking out the pickup roller, the paper feeding roller, or the separation roller, and the opening and closing member is arranged slidably in the insertion and removal direction of the paper feeding cassette, the opening and closing member is not removed from a mounting portion.

As a result, it is possible to provide a paper feeding apparatus and an image forming apparatus that can reliably return a cover member to an original position at the time of maintenance and eliminating an unstable factor of pull-in failure.

The above-described objects, other objects, features, and advantages of the present disclosure will be further obvious from the detailed description of examples given below with reference to the drawings.

DETAILED DESCRIPTION OF THE DISCLOSURE

Figure 1:
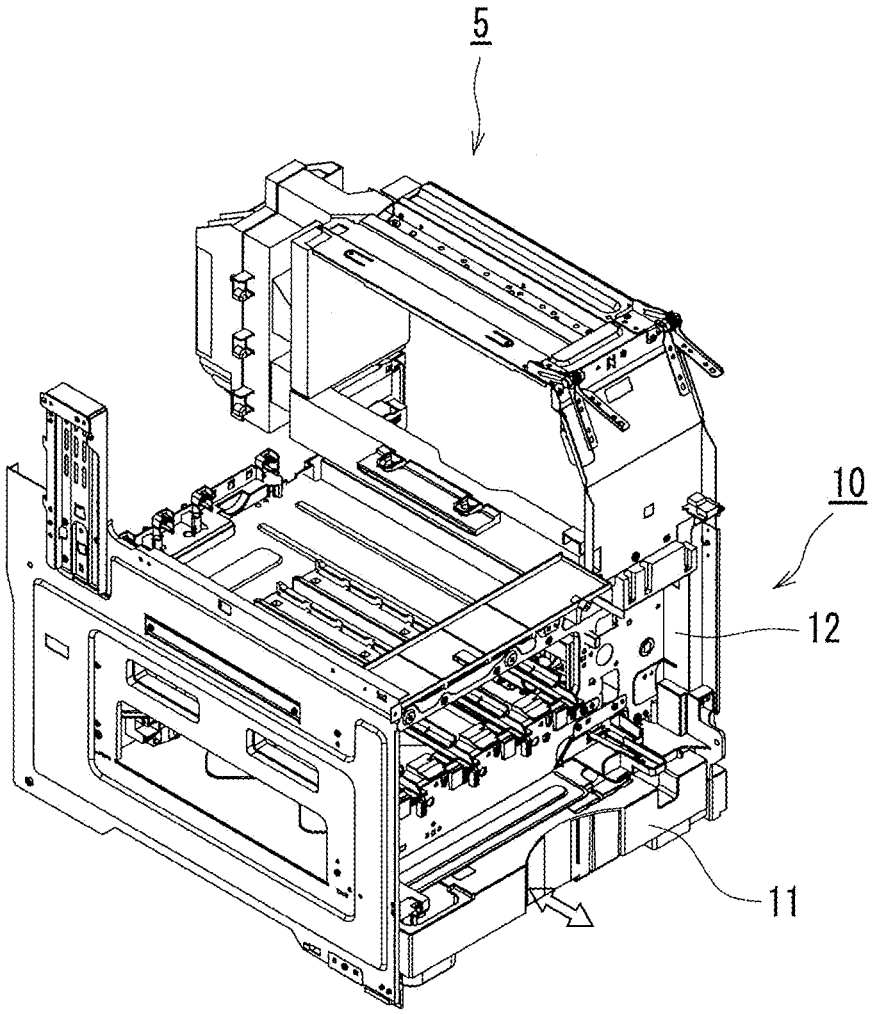
FIG. 1 is a perspective view of an image forming apparatus including a paper feeding apparatus according to one embodiment of the present disclosure as viewed from obliquely above in an insertion and removal direction of a paper feeding cassette.

One embodiment of the present disclosure will be described below with reference to the drawings. FIG. 1 is a perspective view of an image forming apparatus 5 including a paper feeding apparatus 10 according to one embodiment of the present disclosure as viewed obliquely from above in an insertion and removal direction of a paper feeding cassette 11. Here, the paper feeding apparatus 10 accommodates a paper feeding cassette 11 of one tier.

Here, the insertion and removal direction of the paper feeding cassette 11 is indicated by a large arrow. Here, an upper portion of the paper feeding cassette 11 is covered with a process unit cover 12, and a paper feeding unit 14 (see FIG. 2) therein is not visible here.

Figure 2:
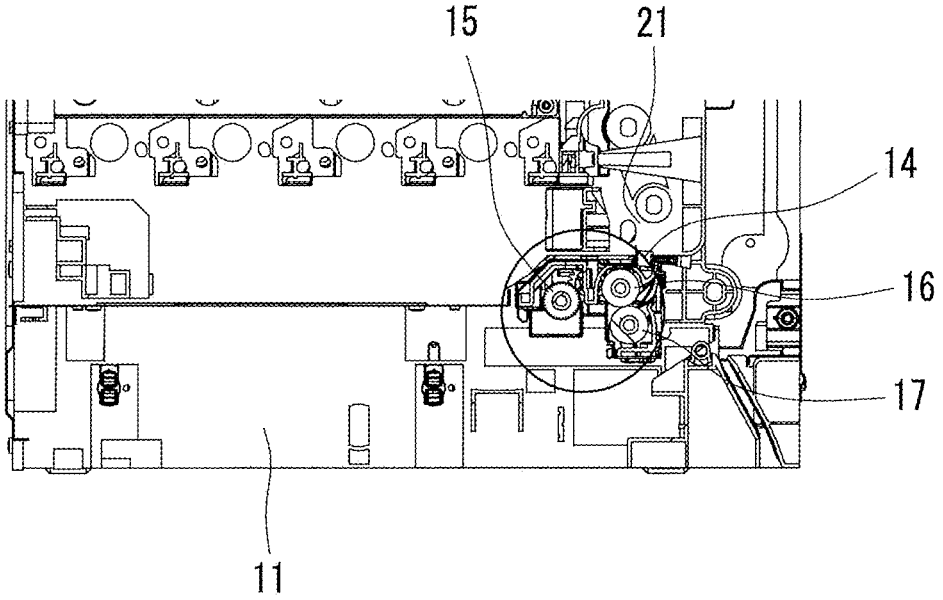
FIG. 2 is a cross-sectional view of the paper feeding apparatus according to one embodiment of the present disclosure as viewed from a side surface in the insertion and removal direction of the paper feeding cassette.

FIG. 2 is a cross-sectional view of the paper feeding apparatus 10 according to one embodiment of the present disclosure as viewed from the side surface in the insertion and removal direction of the paper feeding cassette 11, and the paper feeding unit 14 is provided to be surrounded by a circle in the upper right of the paper feeding cassette 11.

The paper feeding unit 14 includes a pickup roller 15 for pulling out, on a one-by-one basis, sheets not illustrated stacked thereon from the paper feeding cassette 11, a paper feeding roller 16 that sends the sheets pulled out by the pickup roller 15 to a conveyance path 21 on the downstream in the sheet conveyance direction, and a separation roller 17 that abuts on the paper feeding roller 16 and prevents double feeding of the sheets.

Note that the process unit arranged in the process unit cover 12 includes an exposure apparatus and a toner cartridge. FIG. 2 illustrates a cross section of a center portion in the sheet conveyance direction of the paper feeding cassette 11. A guide portion is provided in the vicinity of the paper feeding unit 14 in order to guide sheets not illustrated stacked on the paper feeding cassette 11 to the conveyance path 21, and this will be described later.

Figure 3:
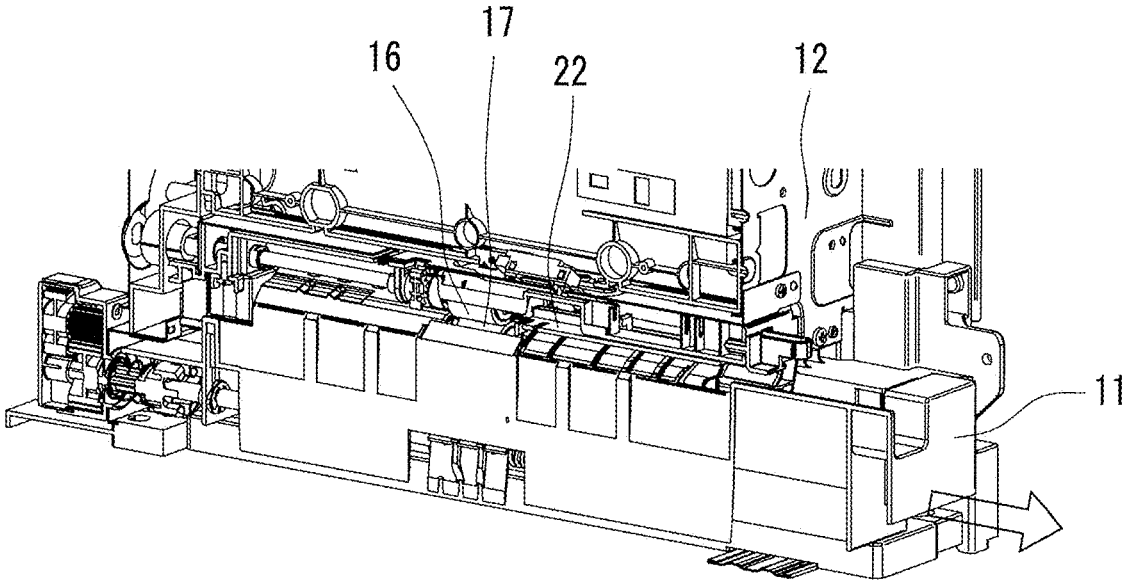
FIG. 3 is a perspective view of a back side in a sheet conveyance direction of the paper feeding cassette.

FIG. 3 is a perspective view of the back side in the sheet conveyance direction of the paper feeding cassette 11 and is a view in which a part of the process unit cover 12 illustrated in FIG. 1 is broken. FIG. 3 illustrates only a part of the end portion in the insertion and removal direction of the paper feeding cassette 11. The pullout direction of the paper feeding cassette 11 is indicated by a large arrow. In the drawing, the paper feeding roller 16 and the separation roller 17 are visible as a part of the paper feeding unit 14 on the back side in the direction intersecting the pullout direction of the paper feeding cassette 11. Note that here, a roller cover (opening and closing member) 22 described later is also illustrated for easy understanding.

Next, a configuration for exposing a work space in order to replace the pickup roller 15, the paper feeding roller 16, and the separation roller 17, which constitute the paper feeding unit 14, will be described.

First Embodiment

Figure 4:
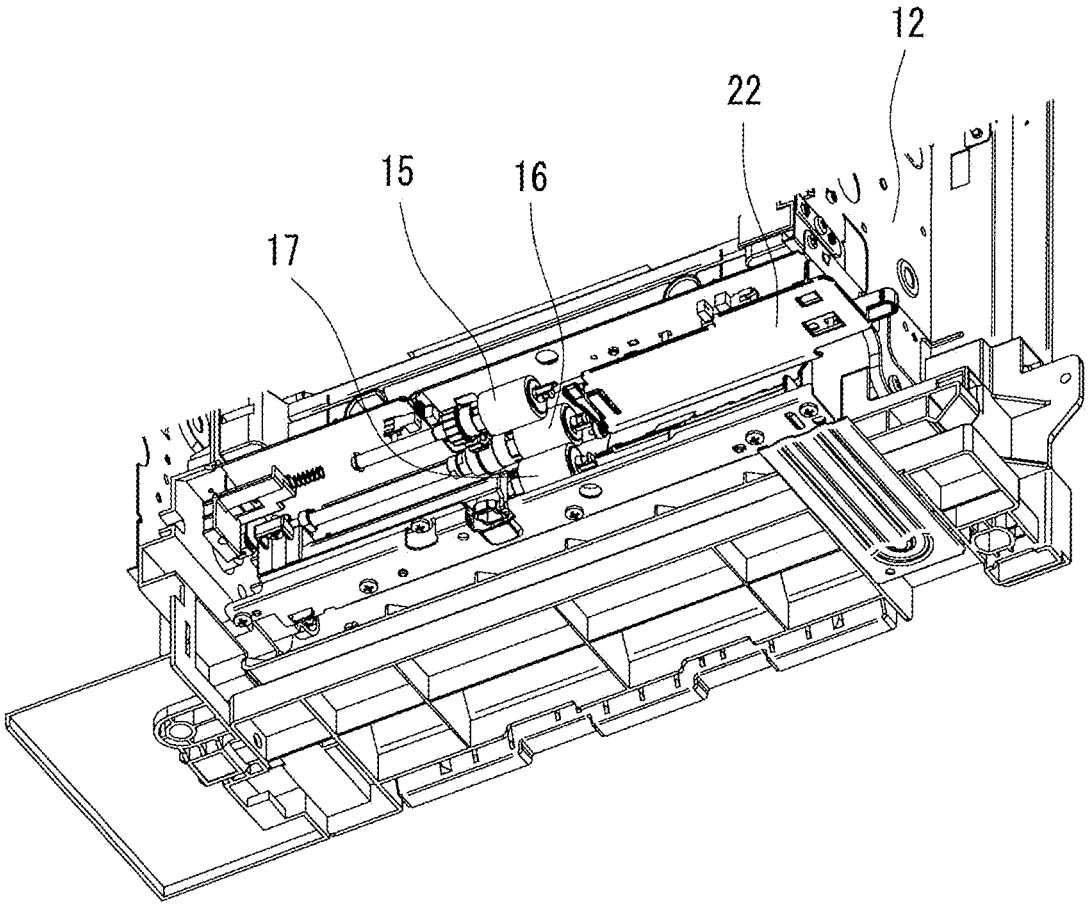
FIG. 4 is a perspective view of the paper feeding apparatus according to a first embodiment of the present disclosure as viewed from a bottom surface of the paper feeding apparatus in a state where the paper feeding cassette is pulled out.
Figure 5:
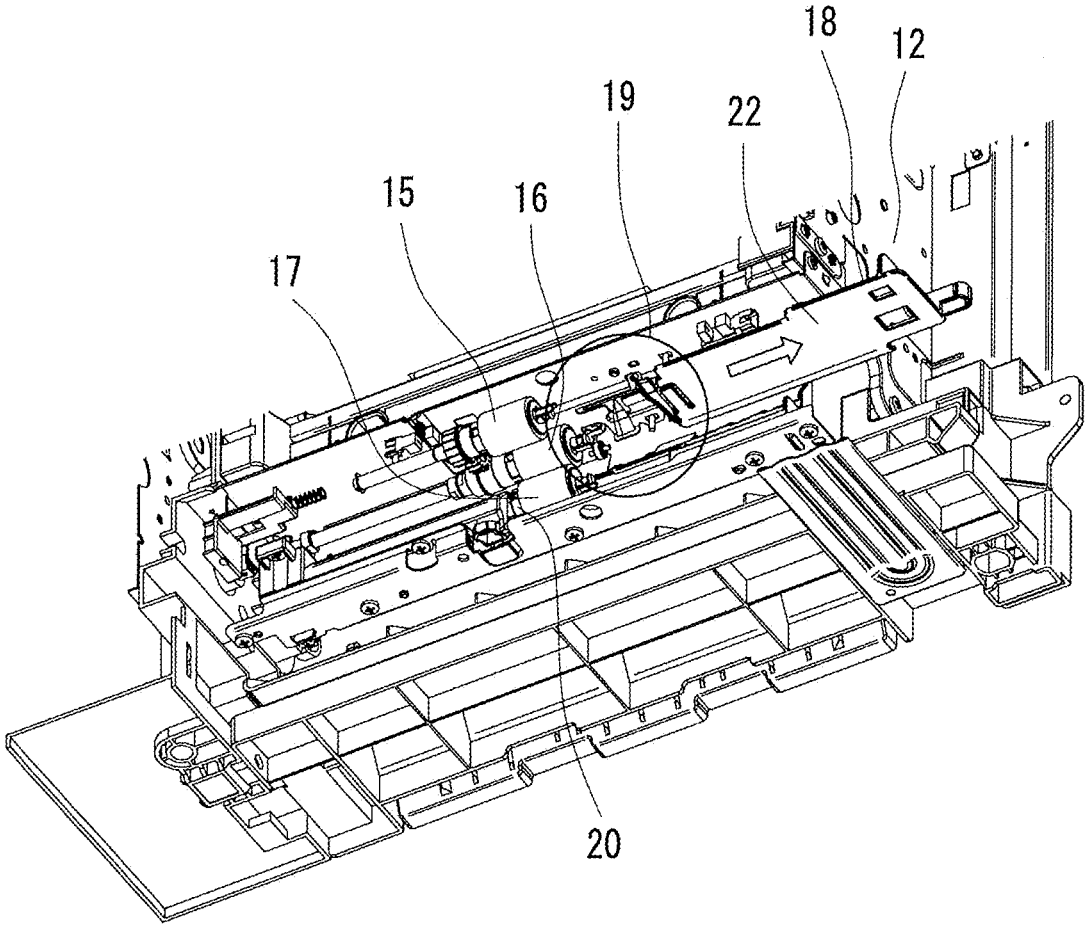
FIG. 5 is a perspective view of the paper feeding apparatus according to the first embodiment of the present disclosure as viewed from the bottom surface of the paper feeding apparatus in the state where the paper feeding cassette is pulled out.

First, the first embodiment of the present disclosure will be described. In the first embodiment, the opening and closing member that is manually operated to provide a space in order to expose the space will be described. FIGS. 4 and 5 are perspective views of the paper feeding apparatus 10 viewed from the bottom surface of the paper feeding apparatus 10 with the paper feeding cassette 11 pulled out from the paper feeding apparatus 10. FIG. 4 is a view illustrating each of the rollers 15 to 17 before replacement work is started, and FIG. 5 is a view illustrating a state during replacement work of each of the rollers 15 to 17.

In order to remove the pickup roller 15, the paper feeding roller 16, and the separation roller 17, in the removal direction of each of the rollers 15 to 17 (right direction of the rollers 15 to 17 in FIGS. 4 and 5), a work space 19 (surrounded by a circle in FIG. 5) is provided beside a roller arrangement space 20 in communication with the roller arrangement space 20 in which each of the rollers 15 to 17 is arranged. Therefore, the roller cover 22 is slidably installed beside each of the rollers 15 to 17, and the sliding direction of the roller cover 22 is indicated by a large arrow in FIG. 5.

Note that a back surface of the roller cover 22 (surface of the roller cover 22 when the paper feeding apparatus 10 is viewed obliquely from above in FIG. 3) illustrated in FIG. 4 serves as a guide portion 18 for conveying a sheet not illustrated to the conveyance path 21.

The roller cover 22 is arranged from the paper feeding roller 16 or the separation roller 17 provided in the pullout direction of the paper feeding cassette not illustrated to the end portion of the sheet that can be stacked on the paper feeding cassette not illustrated in the pullout direction of the paper feeding cassette (right direction in FIGS. 4 and 5).

In this manner, the roller cover 22 (surface is the guide portion 18) can be slid in the pullout direction of the paper feeding cassette not illustrated, whereby the guide portion 18 can be provided with the work space 19 for taking out each of the rollers 15 to 17. The roller cover 22 is merely slid along a groove portion not illustrated for sliding in a direction indicated by an arrow in FIG. 5 and is not detached from the groove portion not illustrated.

By sliding the roller cover 22 in this manner and communicating with the roller arrangement space 20 to provide the work space 19, the work space 19 can be closed so that the sheet can pass through the work space 19, and three or at least two of the pickup roller 15, the paper feeding roller 16, and the separation roller 17 can be simultaneously released and replaced.

The roller cover 22 includes an end portion (end portion on the right side in FIGS. 4 and 5) on a side different from the end portion where the work space 19 is exposed, and the end portion of the roller cover 22 on a side different from the end portion where the work space 19 is exposed is slid to the outside of the process unit cover 12 that covers the process unit that forms an image.

Next, a method of closing the work space 19 opened in this manner will be described. In this embodiment, by linking the operation of closing the roller cover 22 with the insertion of the paper feeding cassette 11 into the paper feeding apparatus 10 and closing the paper feeding cassette 11, the roller cover 22 automatically slides in the insertion direction of the paper feeding cassette 11 and returns to the original position. This can prevent attachment omission of the roller cover 22.

Figure 6:
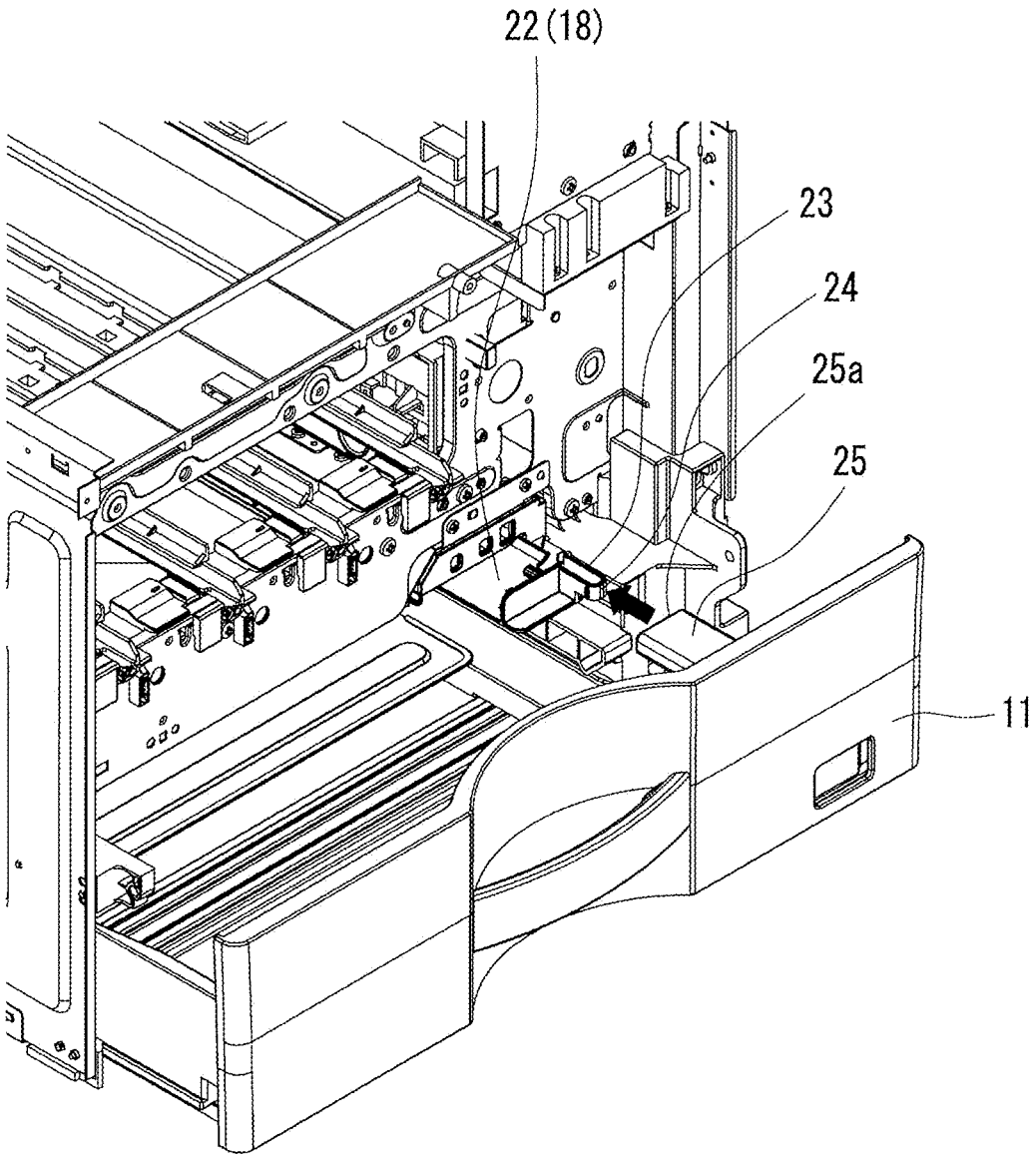
FIG. 6 is a view illustrating a configuration in which the operation of closing the roller cover is linked with insertion of the paper feeding cassette.
Figure 7:
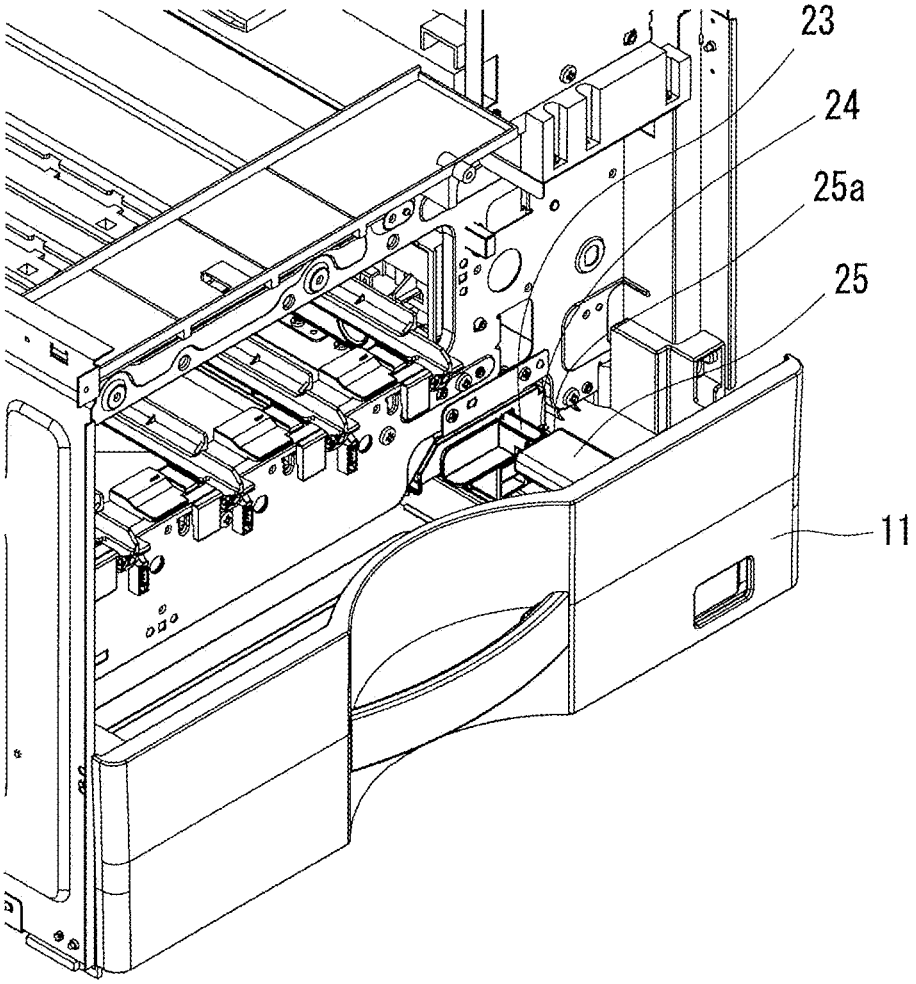
FIG. 7 is a view illustrating a configuration in which the operation of closing the roller cover is linked with insertion of the paper feeding cassette.

FIGS. 6 and 7 are views illustrating a configuration in which the operation of closing the roller cover 22 is linked with the insertion of the paper feeding cassette 11 into the paper feeding apparatus 10. FIG. 6 is a perspective view of a state immediately before the paper feeding cassette 11 is pushed in a state where the roller cover 22 is opened as viewed from above, and FIG. 7 is a view illustrating a state where a short period of time has elapsed from FIG. 6 and is a perspective view of a state immediately before the paper feeding cassette 11 is pushed in a state where the roller cover 22 is opened as viewed from above.

With reference to FIGS. 6 and 7, a main body of the paper feeding cassette 11, an exterior of the paper feeding cassette 11, and the like are provided with a protrusion member 25 protruding in the insertion direction of the paper feeding cassette 11, and the tip of the protrusion member 25 is provided with a contact surface 25*a*.

In this state, when the paper feeding cassette 11 is closed, an abutment portion 24, which is an end surface of a protrusion portion 23 provided on the end portion side in the pullout direction of the paper feeding cassette 11 of the flat roller cover 22, is pressed by the contact surface 25*a* provided on the paper feeding cassette 11, and the roller cover 22 is slid in the direction of closing the work space 19 (see FIG. 5).

As illustrated in FIGS. 6 and 7, the contact surface 25*a* of the protrusion member 25 pushes the abutment portion 24 provided at the roller cover 22. In FIG. 6, a large arrow indicates a direction in which the contact surface 25*a* pushes the abutment portion 24.

As described above, in the paper feeding apparatus 10 of the image forming apparatus 5, the roller cover 22 is slid at the time of maintenance to form the work space 19 (see FIG. 5), and then the paper feeding cassette 11 is inserted, whereby the roller cover 22 reliably returns to the original guide portion 18, and thus it is possible to prevent an erroneous attachment of the roller cover 22.

Second Embodiment

Next, the second embodiment of the present disclosure will be described. Also in the second embodiment, the roller cover is slidable in the pullout direction of the paper feeding cassette, and is slid in the pullout direction to provide a work space beside each roller, and the roller cover is configured not to be detached, which are the same as in the previous embodiment.

The second embodiment is different from the previous embodiment in that the roller cover is biased by a spring so that the roller cover returns to the original closing position.

Figure 8:
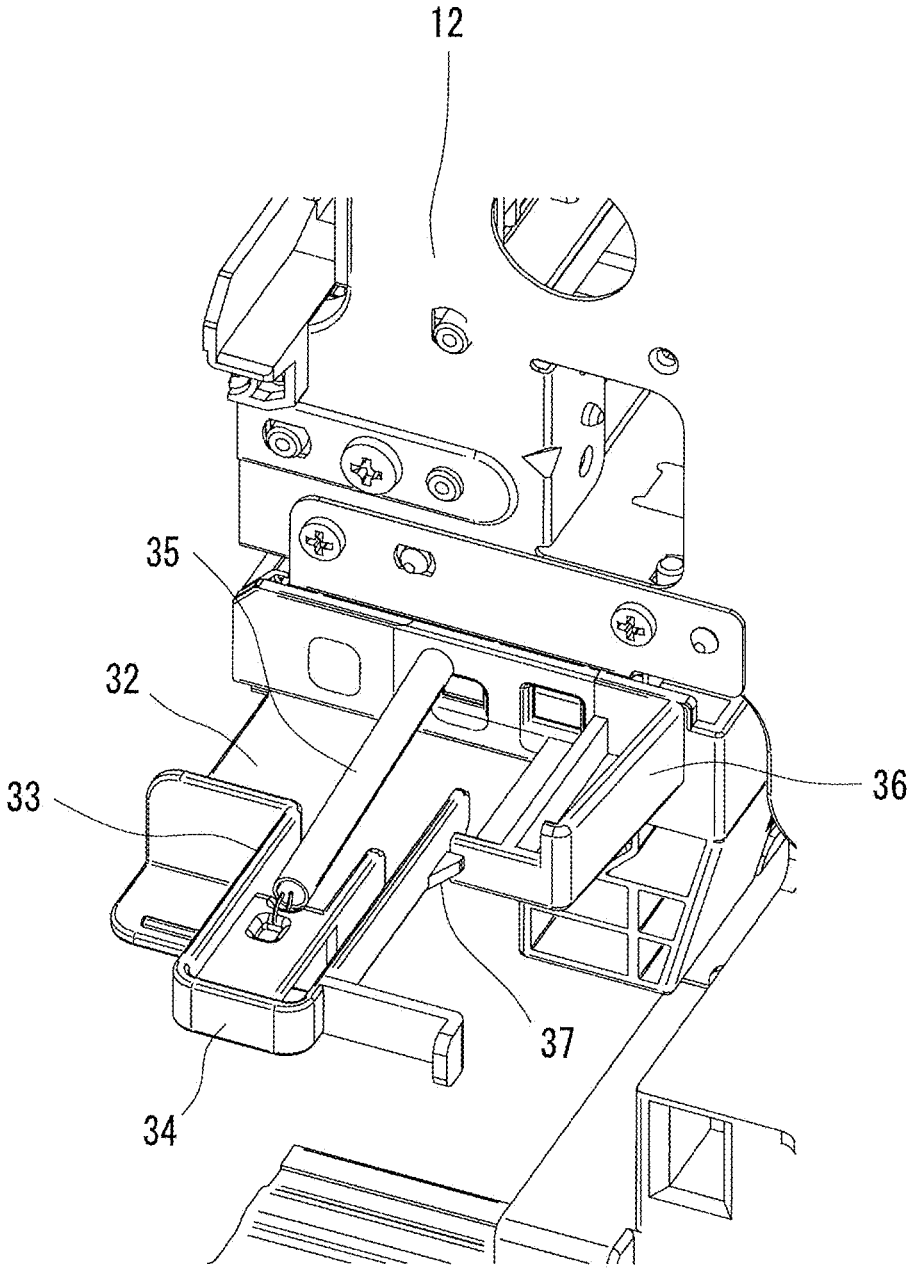
FIG. 8 is a perspective view of a roller cover of a paper feeding apparatus according to a second embodiment of the present disclosure as viewed from the insertion and removal direction of the paper feeding cassette.
Figure 9:
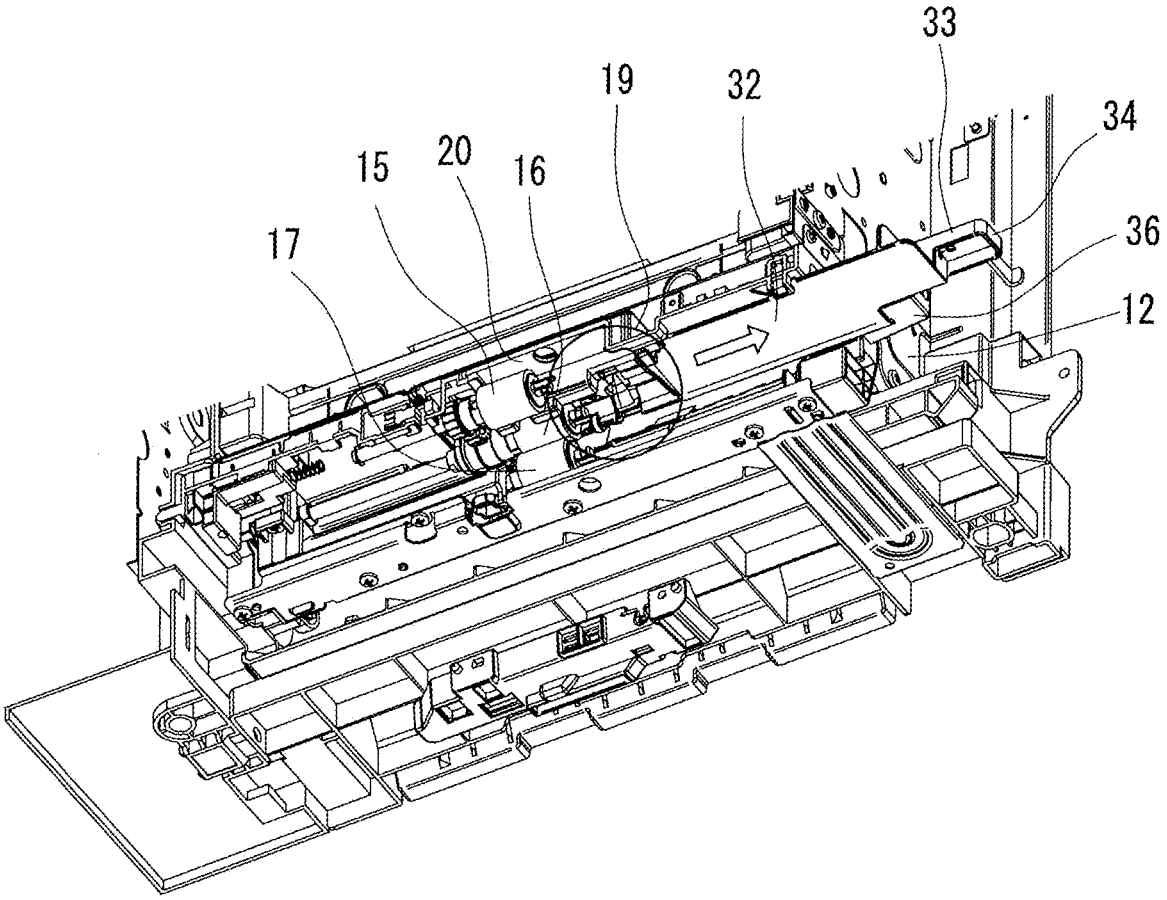
FIG. 9 is a perspective view of the paper feeding apparatus according to the second embodiment of the present disclosure as viewed from the bottom surface of the paper feeding apparatus in the state where the paper feeding cassette is pulled out.

FIG. 8 is a perspective view of a roller cover 32 of the paper feeding apparatus 10 according to the second embodiment of the present disclosure as viewed from the insertion and removal direction of the paper feeding cassette 11. Only the pullout side of the paper feeding cassette 11 of the process unit cover 12 of the roller cover 32 is illustrated. FIG. 9 is a perspective view of the paper feeding apparatus 10 as viewed from the bottom surface of the paper feeding apparatus 10 in a state where the paper feeding cassette 11 is pulled out in the paper feeding apparatus 10 according to the second embodiment of the present disclosure, and the work space 19 communicating with the roller arrangement space 20 is indicated by a circle in the drawing.

In this embodiment, as illustrated in FIG. 8, the roller cover 32 is biased in a direction opposite to the pullout direction by a spring 35. After sliding, the roller cover 32 is biased by the spring 35 because an engagement portion 37 such as a claw provided on the roller cover 32 is hooked on a part of a frame 36 connected to the process unit cover 12, but the roller cover 32 is kept in an open state.

Note that here, the engagement portion 37 is provided on one side of two parallel sides of a protrusion portion 33 protruding in the pullout direction of the paper feeding cassette 11 as viewed from above, provided on the end portion side in the pullout direction of the paper feeding cassette 11 of the flat roller cover 32, and the spring 35 is fixed at a position opposite to an abutment portion 34 provided at the center of the protrusion portion 33.

By manually releasing this engagement portion 37, the roller cover 32 biased by the spring 35 returns to the original position.

In the above embodiments, a case where the engagement portion is manually released has been described, but the present disclosure is not limited to this, and the roller cover may be automatically closed by providing a configuration for releasing the engagement on the paper feeding cassette side and inserting the paper feeding cassette as in the above embodiments.

In the above embodiments, a case where the roller cover is biased by the spring has been described, but the present disclosure is not limited to this, and the roller cover may be biased by using any member having an expansion and contraction function.

The present disclosure may be carried out in other various forms without departing from the spirit or essential characteristics thereof. Thus, the above embodiments are merely examples and should not be interpreted as limiting. All modifications and changes equivalent in scope with the claims of the present disclosure are included in the scope of the present disclosure.

According to the present disclosure, it is possible to provide a paper feeding apparatus that can reliably return an opening and closing member such as a roller cover to an original position at the time of maintenance and eliminating an unstable factor of pull-in failure, and therefore, it is useful as a paper feeding apparatus.

What is claimed is:

1. A paper feeding apparatus comprising:

a pickup roller that pulls out, on a one-by-one basis, sheets stacked on a paper feeding cassette;

a paper feeding roller that sends, to a conveyance path, a sheet pulled out by the pickup roller;

a separation roller that abuts the paper feeding roller and prevents double feeding of the sheets;

a roller arrangement space in which the pickup roller, the paper feeding roller, and the separation roller are arranged;

a work space that communicates with the roller arrangement space and is for taking out the pickup roller, the paper feeding roller, or the separation roller;

a guide portion that closes the work space, such that the sheet passes through the work space, and that guides the sheets stacked on the paper feeding cassette to the conveyance path; and an opening and closing member that is provided with the guide portion and exposes the work space, wherein the opening and closing member is arranged slidably in an insertion and removal direction of the paper feeding cassette, the opening and closing member includes an abutment portion at a first end portion different from a second end portion of the opening and closing member where the work space is exposed, and when the paper feeding cassette abuts the abutment portion, the opening and closing member is slid in a direction of closing the work space.

2. The paper feeding apparatus according to claim 1, wherein the opening and closing member is further arranged from the paper feeding roller or the separation roller to an end portion of the sheets stacked on the paper feeding cassette in a pullout direction of the paper feeding cassette with respect to the paper feeding roller or the separation roller.

3. The paper feeding apparatus according to claim 1, wherein;

the opening and closing member further includes a third end portion on a side different from the second end portion, and the third end portion is slid to an outside of a process unit cover covering a process unit that forms an image.

4. An image forming apparatus comprising the paper feeding apparatus according to claim 1.

* * * * *